US009136586B2

(12) United States Patent
Liu

(10) Patent No.: US 9,136,586 B2
(45) Date of Patent: Sep. 15, 2015

(54) WIRELESS COMMUNICATION DEVICE

(71) Applicant: FIH (Hong Kong) Limited, Kowloon (HK)

(72) Inventor: Chi-Sheng Liu, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 198 days.

(21) Appl. No.: 13/956,602

(22) Filed: Aug. 1, 2013

(65) Prior Publication Data

US 2014/0062800 A1 Mar. 6, 2014

(30) Foreign Application Priority Data

Aug. 29, 2012 (TW) ..... 101131436 A

(51) Int. Cl.
*H01Q 9/00* (2006.01)
*H01Q 1/24* (2006.01)
*H01Q 9/42* (2006.01)

(52) U.S. Cl.
CPC ..... *H01Q 1/24* (2013.01); *H01Q 1/243* (2013.01); *H01Q 9/42* (2013.01)

(58) Field of Classification Search
CPC ..... H01Q 1/24; H01Q 1/243; H01Q 9/42
USPC ..... 343/700 MS, 702, 745
See application file for complete search history.

(56) References Cited

U.S. PATENT DOCUMENTS

| | | | | |
|---|---|---|---|---|
| 3,474,453 | A * | 10/1969 | Ireland | 343/745 |
| 5,146,235 | A * | 9/1992 | Frese | 343/895 |
| 6,437,747 | B1 * | 8/2002 | Stoiljkovic et al. | 343/702 |
| 6,639,564 | B2 * | 10/2003 | Johnson | 343/702 |
| 7,176,840 | B1 * | 2/2007 | Kelley | 343/745 |

* cited by examiner

*Primary Examiner* — Tho G Phan
(74) *Attorney, Agent, or Firm* — Novak Druce Connolly Bove + Quigg LLP

(57) ABSTRACT

A wireless communication device includes a cover, an antenna, and an adjusting member. The adjusting member is slidably mounted to the cover and is made of non-conductive materials. The antenna includes a radiator, the radiator is mounted on the cover and is shielded by the adjusting member. The adjusting member slides relative to the cover to shield different areas of the radiator.

13 Claims, 3 Drawing Sheets

WIRELESS COMMUNICATION DEVICE

CROSS-REFERENCE TO RELATED APPLICATIONS

This application is one of the two related co-pending U.S. patent applications listed below. All listed applications have the same assignee. The disclosure of each of the listed applications is incorporated by reference into each of the other listed applications.

| Attorney Docket No. | Title | Inventors |
|---|---|---|
| US 46577 | WIRELESS COMMUNICATION DEVICE | CHI-SHENG LIU |
| US 46578 | WIRELESS COMMUNICATION DEVICE | CHI-SHENG LIU |

BACKGROUND

1. Technical Field

The present disclosure relates to wireless communication devices, and particularly to a wireless communication device having function of fine-tuning frequencies of wireless signals.

2. Description of Related Art

Antennas are important elements of wireless communication devices (such as mobile phones). When working conditions of the wireless communication devices change (e.g., ambient temperatures, humidity, and photographic methods), working characteristics of the antennas are easily influenced. Thus, frequency offset of the antennas may occur, i.e., the central frequencies of wireless signals send/received by the antennas may change. As a result, communication quality of the wireless communication devices may be adversely affected.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
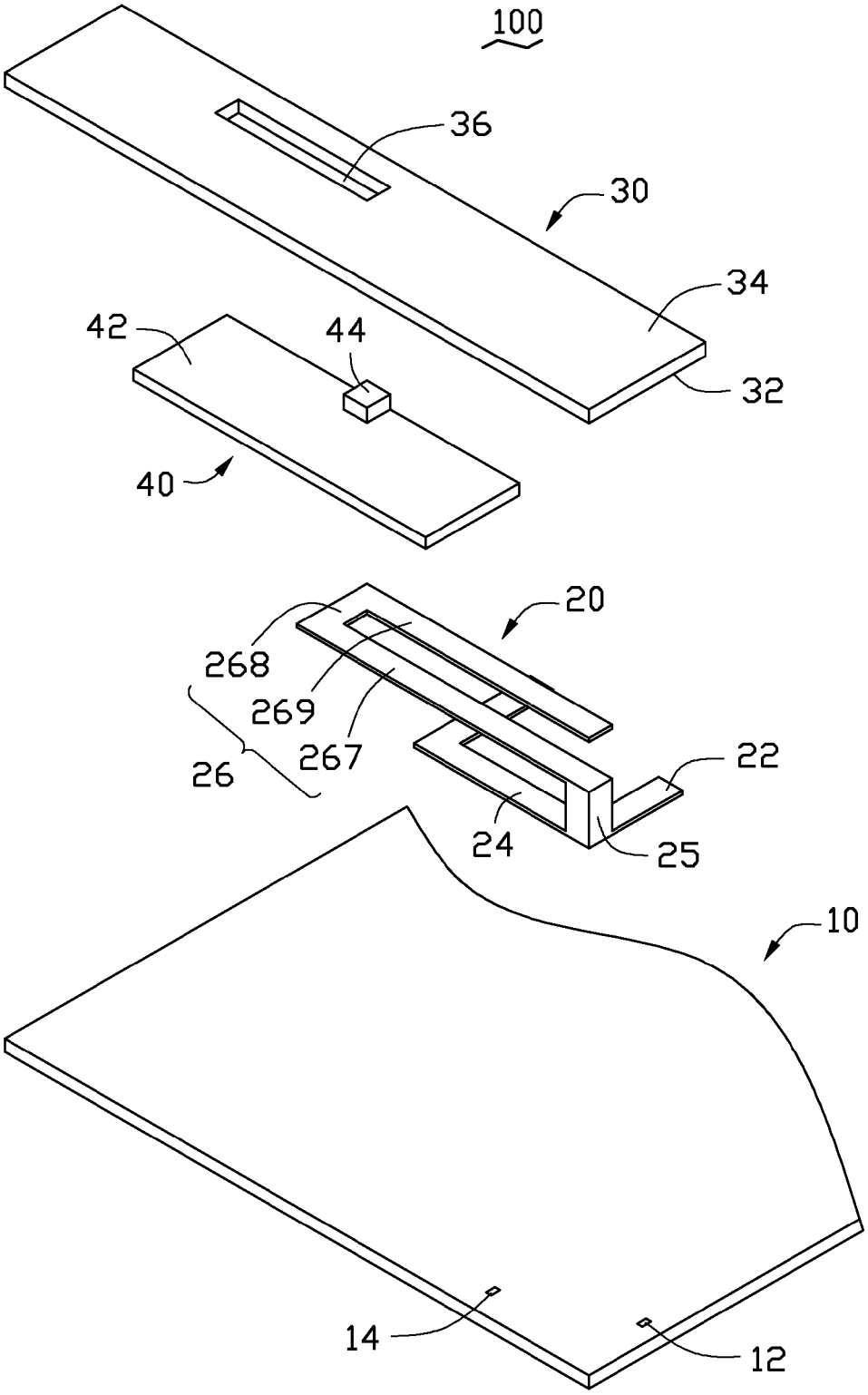
FIG. 1 is an exploded view of a wireless communication device, according to an exemplary embodiment.

FIG. 1 shows a wireless communication device 100, according to an exemplary embodiment. The wireless communication device 100 can be a mobile phone or a personal digital assistant (PDA).

In one exemplary embodiment, the wireless communication device 100 includes a base 10, an antenna 20, a cover 30, and an adjusting member 40.

The base 10 can be a printed circuit board (PCB) of the wireless communication device 100. A feed connector 12 and a grounding connector 14 are electrically mounted on the base 10. The feed connector 12 provides current to the antenna 20, and the antenna 20 is grounded by the grounding connector 14.

The antenna 20 is made of conductive materials, such as metal. The antenna 20 is used to receive/send wireless signals, such as wireless fidelity (WIFI) signals or global position system (GPS) signals. In the exemplary embodiment, the antenna 20 includes a feed end 22, a grounding end 24, a connecting portion 25, and a radiator 26. The feed end 22 is a planar sheet, and is horizontally mounted on the base 10 and electrically connected to the feed connector 12. The grounding end 24 is a bent L-shaped sheet, a first end of the grounding end 24 is electrically connected to the grounding connector 14, and a second end of the grounding end 24 is connected to the feed end 22.

In one exemplary embodiment, the connecting portion 25 is a rectangle post. The connecting portion 25 is perpendicularly connected to the feed end 22 and the grounding end 24, and supports the radiator 26 above the base 10.

The radiator 26 is a planar sheet parallel to the base 10. The radiator 26 includes a first section 267, a second section 268, and a third section 269. The first section 267 is connected to an end opposite to the feed end of the connecting portion. The second section 268 is perpendicularly connected between the first section 267 and the third section 269. The third section 269 and the first section 267 are positioned parallel to each other and extend along two opposite directions. In one exemplary embodiment, a length of the first section 267 is greater than a length of the third section 269.

The cover 30 covers the base 10 and the antenna 20, and includes an inner surface 32 and an outer surface 34 opposite to the inner surface 32. The cover 30 further defines a mounting hole 36 communicating with the inner surface 32 and the outer surface 34. When the antenna 20 is covered by the cover 30, the radiator 26 is substantially mounted on the inner surface 32.

The adjusting member 40 is made of plastic or some other non-conductive material, which have a dielectric coefficient greater than air. The adjusting member 40 includes a shielding board 42 and an operating portion 44. The shielding board 42 is adjacent to the inner surface 32 of the cover 30, and thus a gap (not labeled) is defined between the shielding board 42 and the inner surface 32 to receive at least a part of the radiator 26. The operating portion 44 is formed on the shielding board 42, and passes through the mounting hole 36 to slide relative to the cover 30. Pushing the operating portion 44 with an external force causes the adjusting member 40 to slide relative to the cover 30 to change areas of the radiator 26 shielded by the shielding board 42.

In one exemplary embodiment, an original relative position between the adjusting member 40 and the cover 30 allows about one-third of the area of the radiator 26 to be shielded by the shielding board 42. Thus, the antenna 20 can receive/send wireless signals at a central frequency of about 1575 MHz, such as GPS signals.

Figure 2:
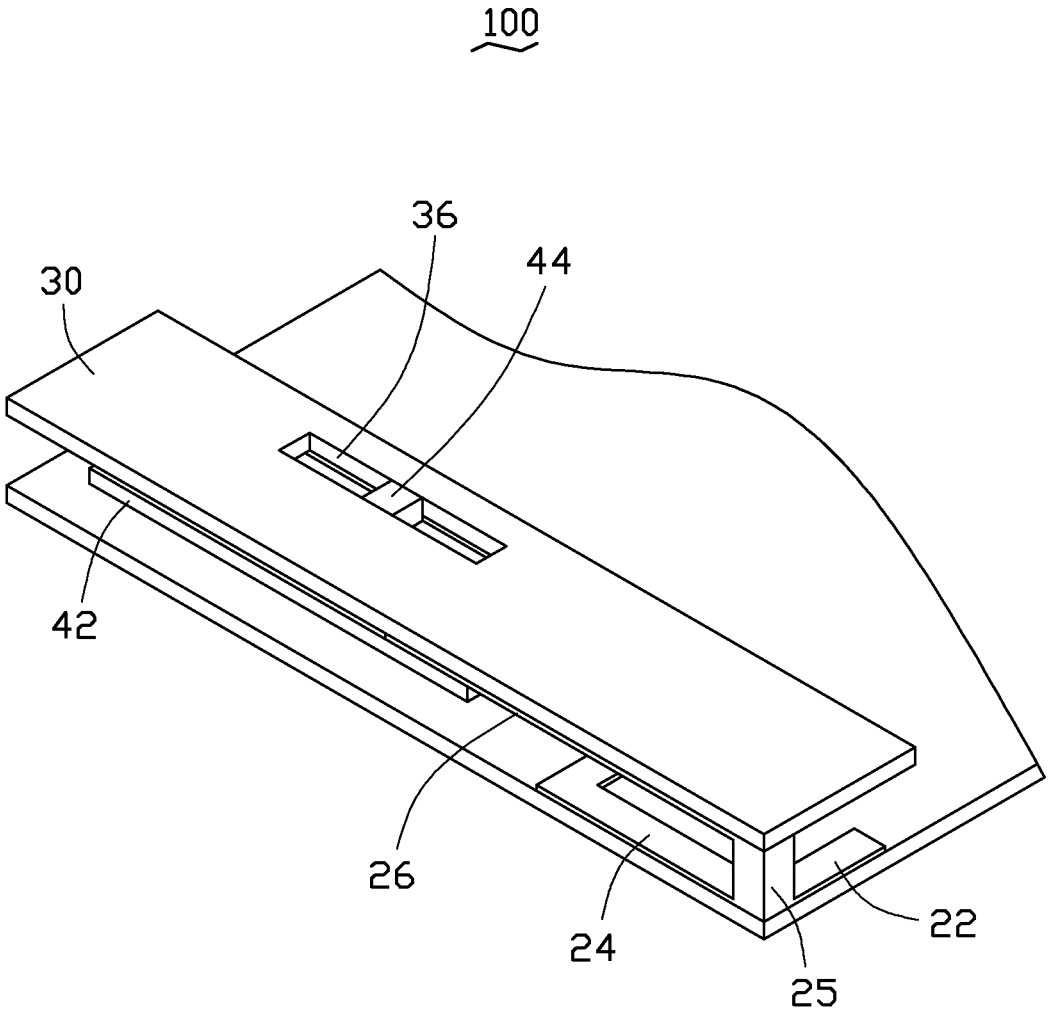
FIG. 2 is an assembled, isometric view of the wireless communication device of FIG. 1 in a first state.
Figure 3:
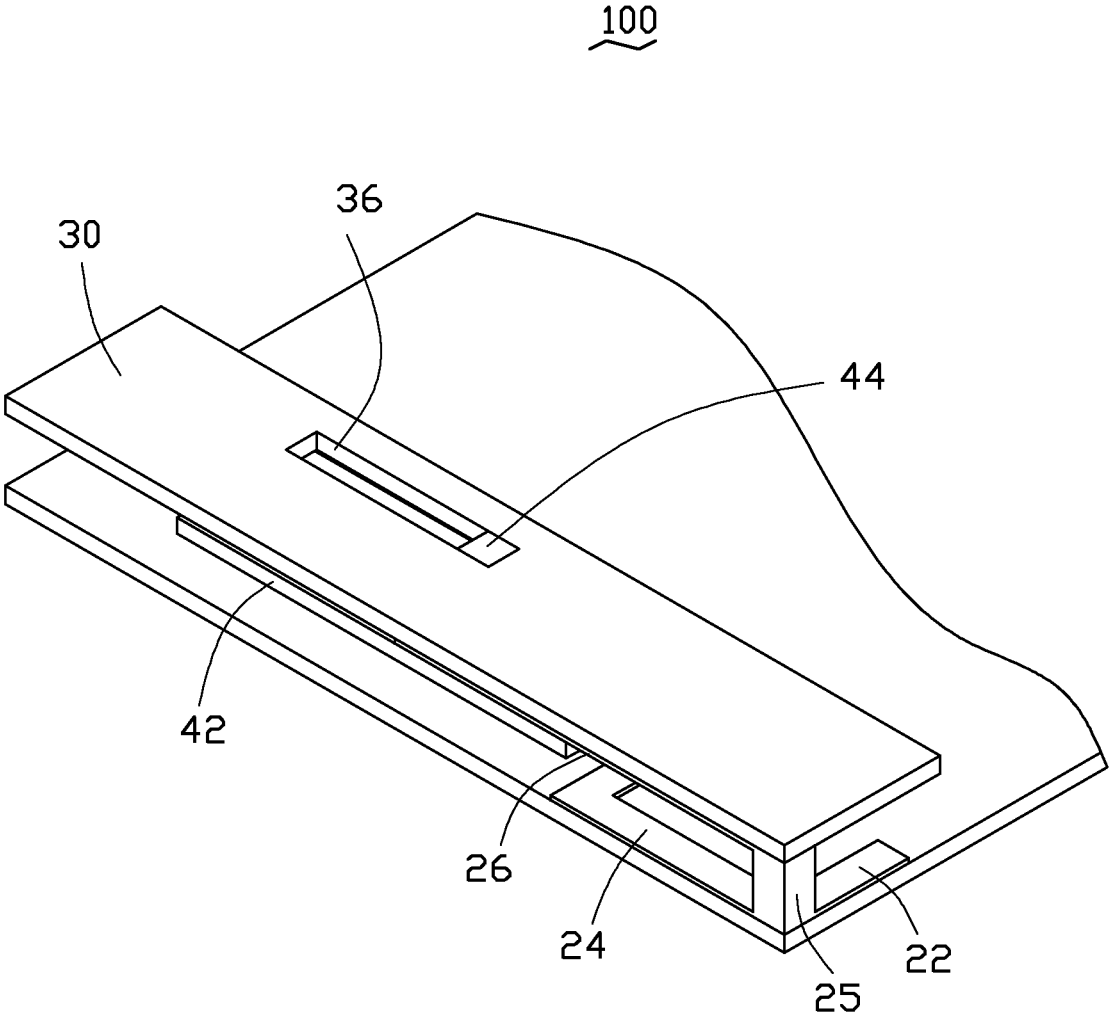
FIG. 3 is an assembled, isometric view of the wireless communication device of FIG. 1 in a second state.

FIGS. 2-3 show that when the wireless communication device 100 is in use, if working conditions of the wireless communication devices change (e.g., ambient temperatures, humidity, and photographic methods), frequency offset of the antenna 20 may occur. For example, if the central frequencies of the wireless signals are increased, the operating portion 44 is pushed towards to the connecting portion 25, thus, more areas of the radiator 26 are shielded by the shielding board 42. Since the dielectric coefficient of the adjusting member 40 is greater than the dielectric coefficient of air, a resonance wavelength required by the antenna 20 is increased. Thus, the central frequencies of the wireless signals are decreased, and the frequency offset of the antenna 20 is eliminated to receive/send desired wireless signals.

If the central frequencies of the wireless signals are decreased, the operating portion 44 is pushed away from the connecting portion 25, thus, less areas of the radiator 26 are shielded by the shielding board 42, and the resonance wavelength required by the antenna 20 is reduced. Thus, the central frequencies of the wireless signals are increased, and the frequency offset of the antenna 20 is eliminated.

The adjusting member 40 slides relative to the cover 30 to change the areas of the radiator 26 shielded by the shielding board 42. Thus, the resonance wavelength required by the antenna 20 can be adjusted to balance the central frequencies of the wireless signal received/sent by the antenna 20. Therefore, communication quality of the wireless communication device 100 can be improved.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A wireless communication device, comprising:

a base;

an antenna disposed on the base, the antenna including a radiator;

a cover covering the base and the radiator; and an adjusting member slidably mounted to the cover and made of non-conductive materials, and the radiator sandwiched between the cover and the adjusting member;

wherein the adjusting member slides relative to the cover to change areas of the radiator shielded by the adjusting member.

2. The wireless communication device as claimed in claim 1, wherein the cover comprises an inner surface and an outer surface opposite to the inner surface, the radiator is mounted on the inner surface.

3. The wireless communication device as claimed in claim 2, wherein the adjusting member comprises a shielding board, the shielding board is adjacent to the inner surface, and the radiator is positioned between the shielding board and the inner surface.

4. The wireless communication device as claimed in claim 3, wherein the cover defines a mounting hole communicating with the inner surface and the outer surface, the adjusting member further comprises an operating portion, the operating portion is formed on the shielding board, and passes through the mounting hole.

5. The wireless communication device as claimed in claim 1, wherein the dielectric coefficient of the adjusting member is greater than the dielectric coefficient of air.

6. The wireless communication device as claimed in claim 1, wherein a feed connector and a grounding connector are electrically mounted on the base, the antenna comprises a feed end and a grounding end, the feed end is a planar sheet, and is horizontally mounted on the base and electrically connected to the feed connector, a first end of the grounding end is electrically connected to the grounding connector, and a second end of the grounding end is connected to the feed end.

7. The wireless communication device as claimed in claim 6, wherein the antenna further comprises a connecting portion, the connecting portion is perpendicularly connected to the feed end and the grounding end, and supports the radiator above the base.

8. The wireless communication device as claimed in claim 7, wherein the radiator is a planar sheet parallel to the base.

9. The wireless communication device as claimed in claim 7, wherein the radiator comprises a first section, a second section, and a third section, the first section is connected to an end opposite to the feed end of the connecting portion, the second section is perpendicularly connected between the first section and the third section, the third section and the first section are positioned parallel to each other and extend along two opposite directions.

10. A wireless communication device, comprising:

a cover;

an antenna including a radiator; and an adjusting member slidably mounted to the cover and made of non-conductive materials;

wherein the radiator is mounted on the cover and is shielded by the adjusting member, the adjusting member slides relative to the cover to shield different areas of the radiator.

11. The wireless communication device as claimed in claim 10, wherein the cover includes an inner surface and an outer surface opposite to the inner surface, the radiator is mounted on the inner surface.

12. The wireless communication device as claimed in claim 11, wherein the adjusting member includes a shielding board, the shielding board is adjacent to the inner surface, and the radiator is positioned between the shielding board and the inner surface.

13. The wireless communication device as claimed in claim 12, wherein the cover defines a mounting hole communicating with the inner surface and the outer surface, the adjusting member further includes an operating portion, the operating portion is formed on the shielding board, and passes through the mounting hole.

* * * * *